US005733134A

United States Patent [19]

Iizuka et al.

[11] Patent Number: 5,733,134

[45] Date of Patent: Mar. 31, 1998

[54] COVERING FIXING STRUCTURE TO AN END SURFACE OF A TUBULAR BODY

[75] Inventors: Hiroaki Iizuka; Hiraku Tanaka; Norihito Suzuki, all of Shizuoka-ken, Japan

[73] Assignee: Yazaki Corporation, Tokyo, Japan

[21] Appl. No.: 756,027

[22] Filed: Nov. 26, 1996

[30] Foreign Application Priority Data

Nov. 29, 1995 [JP] Japan ..... 7-311170

[51] Int. Cl.[6] ..... H01R 35/04

[52] U.S. Cl. ..... 439/164; 439/15

[58] Field of Search ..... 439/164, 15

[56] References Cited

U.S. PATENT DOCUMENTS

| | | | |
|---|---|---|---|
| 5,100,331 | 3/1992 | Banfelder | 439/164 |
| 5,106,316 | 4/1992 | Bannai et al. | 439/164 |
| 5,429,508 | 7/1995 | Brevick | 439/15 |

FOREIGN PATENT DOCUMENTS 3-14296 4/1991 Japan .

*Primary Examiner*—Gary F. Paumen

*Attorney, Agent, or Firm*—Finnegan, Henderson, Farabow, Garrett & Dunner, L.L.P.

[57] ABSTRACT

A cover fixing structure for an end surface of a tubular body according to the present invention is constructed such that it comprises: a plurality of projections 1 having a tip end hook portion 1*a* on the mounting surface of an external joint cover 110 which is to be fitted onto the end surface of the tubular body 11, a groove 3 for receiving the locking projection formed at the position corresponding to the locking projection 1, a rib 5 formed on the inner surface of the external peripheral wall of the tubular body 11 within the groove 3, the groove 3 is formed with a through hole 3*a* for receiving the hook portion 1*a* on the inner peripheral wall of the tubular body 11, wherein gap between the inner end portion of the rib 5 and the inner peripheral wall of the tubular body 11 is made substantially equal to the thickness of the locking projection 1, and the rib 5 is formed with a tapering surface inclined toward the entrance side of the groove 3

7 Claims, 7 Drawing Sheets

COVERING FIXING STRUCTURE TO AN END SURFACE OF A TUBULAR BODY

BACKGROUND OF THE INVENTION

1. Field of the Invention

The present invention relates to a structure for fixing a cover to an end surface of a tubular body, and more particularly to a cover fixing structure for use in a non-contact signal transmission device for transmitting signals between relatively rotating members coaxially disposed on a same axis, by electrically connecting these relatively rotating members, by way of a flat cable.

2. Description of the Related Art

Conventionally, there have been occasions in which one member fixed on a shaft and another member rotating about this shaft should be electrically connected, or signals should be transmitted therebetween. For example, in the field of automotive vehicles in which an electronic controlling technology is highly developed, various types of switches for electronic control and/or electrical devices such as air bags should be installed to a steering wheel (or just referred to a handle) for steering the direction of each vehicle, and these switches and electrical devices have to be connected with a steering column by an electrical cable distribution. However, since the handle is arranged such that it can be rotated to the left or right only to a limited plural numbers, for an electrical connection between the rotation axis of the handle and the steering column, either a brush, or a resilient cable that can move in accordance with a rotation of the handle, namely a flexible flat cable (hereinafter referred to just as a flat cable) generally provided with a plurality of conductive leads, should be mounted between the handle and the steering column.

However, the structure in which the handle and the steering column are connected with each other by way of a brush is not highly reliable due to the fact that there is a mechanically sliding contact included therebetween, and accordingly a brushless non-contact signal transmission device using a flat cable has been proposed. In this non-contact electrical device, a flat cable is accommodated in a spiral shape or in a reverse spiral shape by turning round in its half way between the tubular body, which is fixed to the handle shaft and rotates with the handle shaft, and a housing fixed to the steering column, so that the flat cable can be shifted within the housing in accordance with the rotational movement of the handle shaft.

In the non-contact signal transmission device as constructed above, it is necessary to firmly fit an external joint cover to the tubular body, which is fixed to the handle shaft, via a covering member for covering the flat cable. Consequently, it has also been arranged such that the external joint cover is formed with a through hole, and the inner cylindrical section of the tubular body is formed with a tapping screw, so that the external joint cover is attached to the inner cylindrical section of the tubular body by screw means. However, although they can be firmly connected with each other owing to the above structure, not only the number of devices to be used is increased due to the necessity of the tapping screw, but that of working process is also increased because of this screw fastening operation, thereby to raise the total cost of the device.

With a view to overcoming the above problems, the lower surface of the external joint cover is formed with locking projections each having a hook portion at the tip end thereof, whereas the inner cylindrical section of the tubular body is formed with grooves each for receiving the corresponding locking projection and also with through holes as a locking means for locking the corresponding hook portion therein, so that by fitting the hook portions in the through holes, the external joint cover is fixed in the inner cylindrical section, reducing thereby the number of members to be installed and working operation.

However, in the above fixing structure that the external joint cover and the inner cylindrical section of the tubular body are locked by fitting the locking projections each having a hook portion at the tip end thereof into the corresponding accommodating grooves, since the locking projections are formed substantially vertical with respect to the external joint cover, when an external force caused by external vibration is applied, the hook portion of each locking projection is shifted in the direction in which its locked relation with the locking means is disengaged, and thus the external joint cover is likely to come off from the inner cylindrical section.

In order to solve the above problem, it has been further proposed to form the locking projection rather inclined than substantially vertical with respect to the external joint cover, whereby since the hook portion receives a resistive force applied thereto when the locking projection is inserted into the groove, its locking force with the locking means is reinforced and thus even when some vibration is applied from outside to the external joint cover, the locked relation between the hook portion and the locking means is unlikely to be disconnected due to the thus inclined locking projection.

However, there is also another problem in the above improved construction such that on the occasion that the locking projections of the external joint cover are inserted into the corresponding accommodating grooves of the inner cylindrical section, it is needed to push outwardly the locking projection in order to set the hook portion formed at the tip end of each inclined locking projection back to the substantially vertical position with respect to the external joint cover to align its position with the corresponding groove, which makes it difficult to fix the external joint cover to the inner cylindrical section, and also thereby raising the number of necessary working operations.

SUMMARY OF THE INVENTION

The present invention has been made to solve the above-mentioned problems, and accordingly, it is an object of the present invention to provide a cover fixing structure to an end surface of a tubular body, wherein for fitting an external joint cover as a cover to the tubular body such as a non-contact signal transmission device between relatively rotating members, a locking projection having a hook portion is formed at the external joint cover, the end surface of the tubular body is formed with a groove for receiving the locking projection and a locking section for receiving the hook portion, obviating thereby a tapping screw, reducing the number of mounting works, and also making it possible to prevent the locking projection from being disconnected from the groove due to an external vibration after the external joint cover is fitted on the tubular body, as well as facilitating the insertion of the locking projection into the groove for receiving the locking projection.

In order to attain the above object, the present invention provides a structure for fitting the external joint cover to the end surface of the tubular body, and is composed such that it comprises a plurality of locking projections protrudedly formed on the mounting surface of the external joint cover to be mounted on the end surface of the tubular body, and each having a hook portion at the tip end portion thereof; grooves for receiving the locking projections formed at positions corresponding thereto on the end surface of the tubular body; a rib formed on the inner surface of the external peripheral wall of the tubular body within the grooves for receiving the locking projections; and a through hole formed on the inner peripheral wall of the tubular body within each of the grooves for receiving the hook portion as a locking section to lock each of the locking projections, wherein the rib is formed such that the gap between the rib and the inner peripheral wall of the tubular body is equal to the thickness of the locking projection, and is also provided with a tapering surface inclined toward the entrance of the groove. In this structure above, it will be better to prearrange the position and the shape of the locking projection and of the groove for receiving it in order that the locking projection can be locked with the locking projection receiving groove only in one way. Further, it will also be better to provide a positioning projection at the mounting surface and groove for receiving the positioning projection on the end surface of the tubular body, so that the external joint cover fitted to the tubular body is prohibited from rotating in the peripheral direction thereof.

As a result, for fitting an external joint cover to an end surface of the tubular body such as a non-contact signal transmission device between relatively rotating members, the locking projection is first inserted into the groove formed in the tubular body, and then the rib pushes the locking projection from the rear surface side thereof to prevent the shifting movement of the locking projection, obviating thereby a tapping screw, reducing the number of mounting works, and also making it possible to prevent the locking projection from being disconnected from the groove due to an external vibration, as well as preventing the occurrence of rattling after the external joint cover has been fitted to the tubular body.

BRIEF DESCRIPTION OF THE DRAWINGS

FIG. 3A is a perspective view of the assembled structure representing one embodiment of the cover fixing structure to an end surface of the tubular body of the present invention, whereas

FIG. 4A is a sectional view of the assembled state of the cover fixing structure according to the present invention, whereas

FIG. 5A is a partly enlarged sectional view showing the tolerance of a positioning projection and of a rib provided in the groove for receiving the positioning projection, whereas

FIG. 6A is a partly enlarged sectional view showing the state before the locking projection of FIG. 3A is inserted in the groove for receiving the locking projection, whereas

FIG 7A is a perspective view of an external joint cover of another embodiment formed another locking means thereon according to the present invention, whereas

DESCRIPTION OF THE PREFERRED EMBODIMENTS

One embodiment of a cover fixing structure to an end surface of a tubular body will now be explained, taking a cover fixing structure adopted in a non-contact signal transmission device between relatively rotating members as an example with reference to FIGS. 1 to 7.

Figure 1:
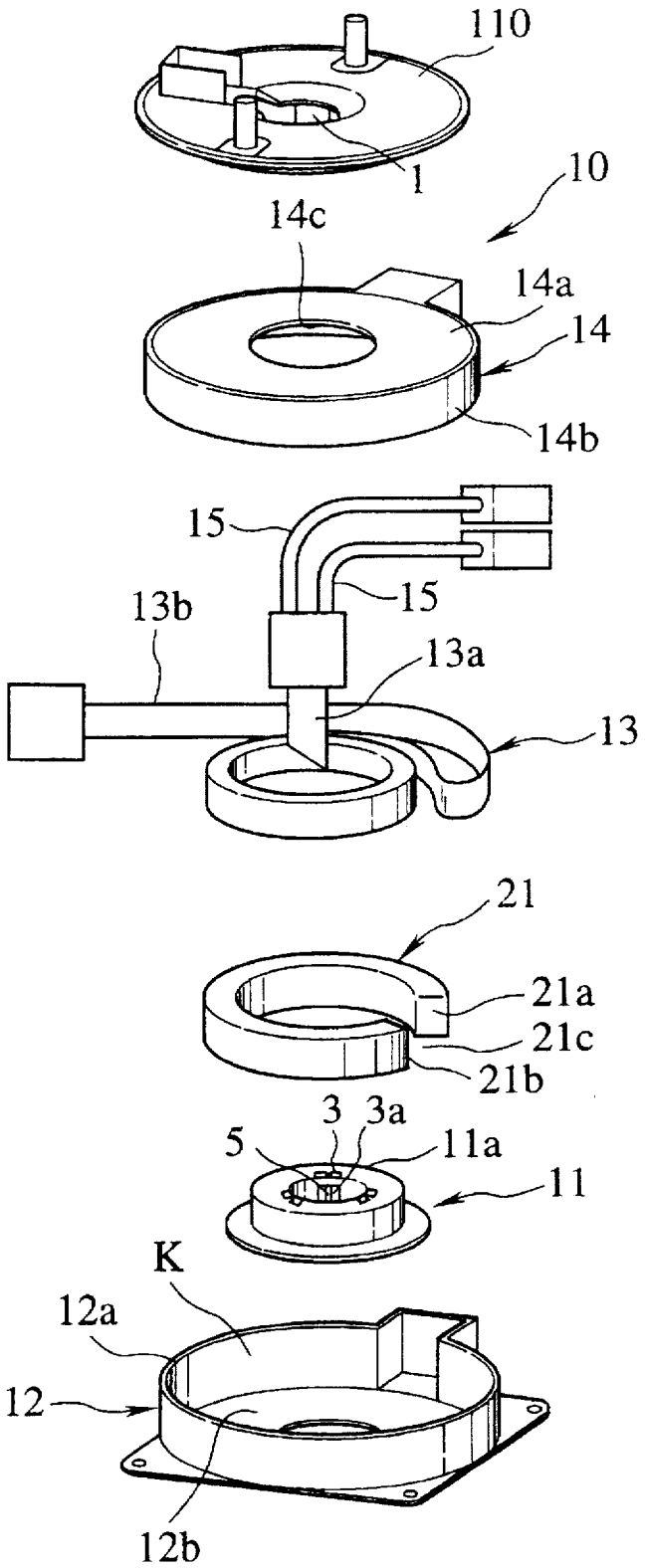
FIG. 1 is an exploded perspective view showing the entire structure of a non-contact signal transmission device for relatively rotating members, representing the assembled state of a cover fixing structure to an end surface of a tubular body according to the present invention.

FIG. 1 is an exploded perspective view showing an assembled state of the non-contact signal transmission device between relatively rotating members, including a cover fixing structure to an end surface of a tubular body according to the present invention. In the figure, it is schematically described that the cover fixing structure to the tubular body is composed of a tubular body 11 having an inner cylindrical section 11*a*, a fixed body 12 having an outer cylindrical section 12*a* encircling the inner cylindrical section 11*a* with a predetermined gap therebetween, and a flat cable 13 which is accommodated in an annular space K between the inner cylindrical section 11*a* and the outer cylindrical section 12*a* in such a state that it is wound and turned round to the reverse helical direction in the middle. The flat cable 13 is movably accommodated along the gap K in such a manner that its inner end 13*a* is retained by the inner cylindrical section 11*a*, while its outer circular end 13*b* is retained by the outer tubular cylindrical section 12*a*. Further as shown in FIG. 1, the non-contact signal transmission device is provided with a C-shape movable body 21 for turning the flat cable 13 to the reverse direction at the opening 21*c* thereof.

The above fixed body 12 is covered by a covering member 14 covering the upper side of the annular space K and the external peripheral surface of the outer cylindrical section 12*a*. The covering member 14 is composed of an upper cover 14*a* covering the upper side of the annular space K and a cylindrical section 14*b* surrounds the external peripheral surface of the outer cylindrical section 12*a*, so that it is unrotatably fitted to the fixed body 12. The upper cover 14*a* is formed with an opening 14*c* in the center portion thereof. The fixed body 12 is further provided with a lower cover 12*b* which is integrally formed with the outer cylindrical section 12*a*, and covering the lower side of the annular space K. Still further, the covering member 14 is rotatably provided with an external joint cover 110 as a cover in a cover fixing structure to an end surface of a tubular body of the present invention. The external joint cover 110 is connected with the inner cylindrical section 11*a* through the opening 14*c* of the covering member 14, whereby the junction between the inner end 13*a* of the flat cable 13 and an external cable 15 is retained.

By this construction above, the tubular body 11 is, for example, connected with a steering wheel of the section of the handle of a vehicle, whereas the fixed body 12 is fixed to the steering column side.

Figure 2:
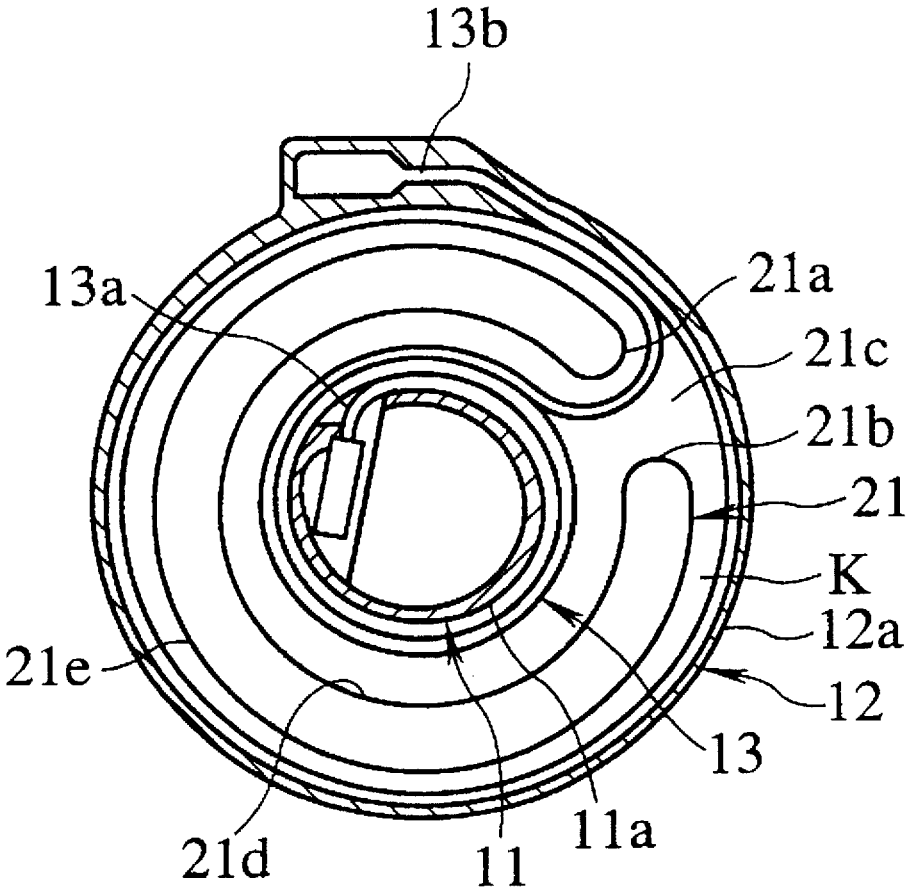
FIG. 2 is a sectional view of a main section showing the functional movement of the non-contact signal transmission device of FIG. 1.

In the non-contact signal transmission device between the respectively rotating members 10 as constructed above, when, for example, the inner cylindrical section 11*a* is rotated in a counter-clockwise direction as shown in FIG. 2, the cable 13 is shifted to wind around the inner cylindrical section 11*a*, and for this reason, the cable 13 outside the movable body 21 is abutted against the external peripheral surface 21*e* of the movable body 21, and further against one end surface 21*a* of the opening to turn round to the reverse direction there and get into the movable body 21, and thereafter winds around the inner cylindrical section 11*a*. In this occasion, the end surface 21*a* of the opening of the movable body 21 is pushed by the cable 13 to rotate in the counter-clockwise direction.

On the other hand, when the inner cylindrical section 11*a* is rotated in the clockwise direction, the cable 13 which had been wound around the inner cylindrical section 11*a* is unwound to shift around the movable body 21. Due to this, the cable 13 wound around the inner cylindrical section 11*a* is abutted against the inner peripheral surface 21*d* of the movable body 21, and further against the other end surface 21*b* of the opening to turn round to the reverse direction and get out to the outer side of the movable body 21, and finally abutted against the inner surface of the outer cylindrical section 12*a*. In this case, the other end surface 21*b* of the opening of the movable body 21 is pushed by the cable 13, and rotates in the clockwise direction.

Next, a detailed structure for fixing the external joint cover 110, as explained in FIG. 1, to the inner cylindrical section 11*a* of the tubular body 11 is now explained below, specially with reference to FIGS. 3A and 3B.

Figure 3A:
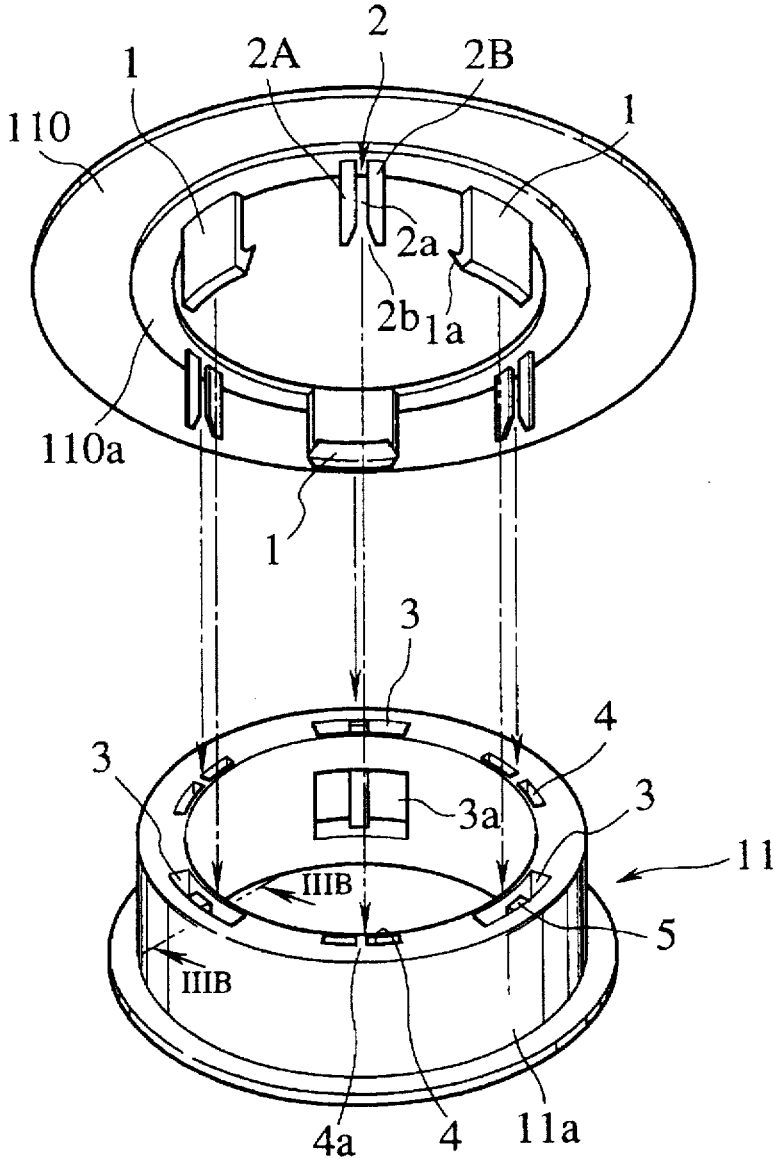
Figure 3B:
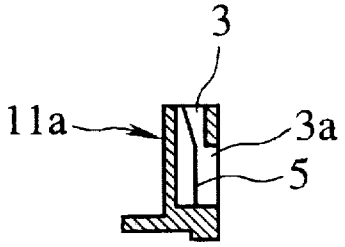
FIG. 3B is a sectional view observed along the line IIIB—IIIB of FIG. 3A.

First of all, FIGS. 3A and 3B are assembled perspective views respectively showing one embodiment of the cover fixing structure to an end surface of a tubular body of the present invention, wherein three locking projections 1 each having a hook portion 1*a* are mounted at equal distance therebetween on the annular mounting surface 110*a* of the external joint cover 110 to be fitted on to the upper end surface of the inner cylindrical section 11*a* which is a tubular shape and has a predetermined thickness. In this embodiment, the locking projections 1 are all located in a concentrical circle with respect to the center of the external joint cover 110 of a circular shape, and the wall surfaces of the respective locking projections 1 are also formed on the arcuate surface along with the concentric circle.

Figure 5A:
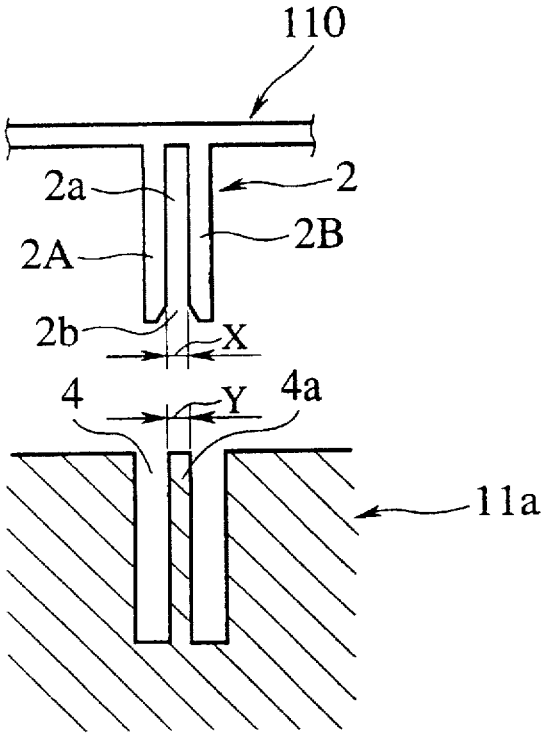
Figure 5B:
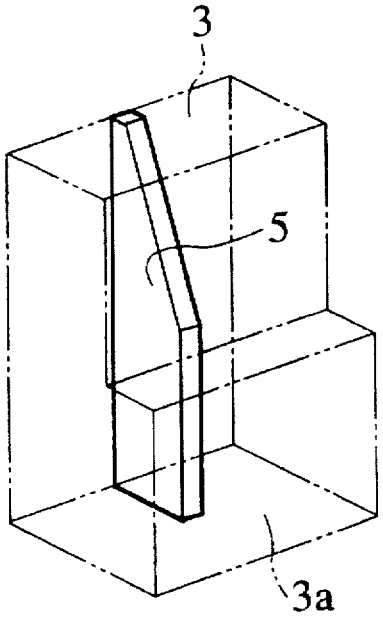
FIG. 5B is a partly enlarged perspective view showing the shape of the rib formed in the groove for receiving the locking projection as shown in FIGS. 3A and 3B.

Further, positioning projections 2 each composed of, as shown in FIG. 5A, two parallel arms 2A an 2B with a predetermined distance X therebetween are disposed respectively on the annular mounting surface 110*a* in the region between the adjacent locking projections 1. There is provided a gap 2*a* between the parallel arms 2A and 2B of each positioning projection 2, and the end portion of this gap 2*a* is expanded to form an expanded section 2*b*.

On the other hand, in the upper side surface of the inner cylindrical section 11*a*, a groove 3 for receiving the locking projection 1 is provided at the position corresponding to each locking projection 1, while a groove 4 for receiving the positioning projection 2 is formed at the position corresponding to each positioning projection 2. In this embodiment, the hook portion 1*a* of the locking projection 1 is formed at the inner peripheral surface thereof, while in the groove 3 for receiving the locking projection 1, a through hole 3*a* is formed as a locking means for receiving the hook portion 1*a* in the inner peripheral surface to lock it. It is to be noted that in case the height of the hook portion 1*a* of the locking projection 1 is rather low, the through hole 3*a* can be a recess formed in the inner peripheral surface of the groove 3 for receiving the locking projection 1. The groove 4 for receiving the positioning projection 2 is formed with a rib 4*a* having a width Y to be engaged with the gap X between the parallel arms 2A and 2B of the positioning projection 2.

Although the width Y is made equal to or smaller than the distance X between the two parallel arms 2A and 2B of the positioning projection 2, it is formed substantially equal to the distance X, so that when the positioning projection 2 is inserted into the groove 4, the external joint cover 110 can be almost perfectly engaged with the tubular body 11 without scarcely any occurrence of rattling in the peripheral direction thereof. Due to this, as explained before, the two parallel arms 2A and 2B of the positioning projection 2 are formed with an expanded section 2*b* that is provided by enlarging the far end portion of the gap 2*a*, facilitating thereby the insertion of the positioning projection 2 into the groove 4.

On the other hand, in the groove 3 for receiving the locking projection 1, a rib 5 is protrudedly formed for urging the locking projection 1 inserted in the groove 3 from the outer surface side. This rib 5 is, as shown in FIG. 3B in detail, protrudedly formed on the inner surface of the external peripheral wall of the tubular body 11 within the groove 3. In this embodiment, the gap S between the inner end portion of the rib 5 and the outer surface of the inner peripheral wall of the tubular body 11 is, as shown in FIG. 6, made in substantially the same length as the thickness T of the locking projection 1. Further, the rib 5 is formed with a tapering surface 3 lowering toward the entrance of the groove 3, which tapering surface being arranged so as for the hook portion 1*a* of the locking projection 1 inserted in the groove 3 to naturally advance into the through hole 3*a*.

It is to be noted that the locking projection 1 and the positioning projection 2 of the external joint cover 110 each mounted at three positions as shown in FIG. 3 are arranged along a relative positioning relation among the locking projection 1, positioning projection 2, the groove 3 for receiving the locking projection 1 and the groove 4 for receiving the positioning projection 2 such that they can be adjusted only in one predetermined way when the locking projection 1 is inserted in the groove 3 and the positioning projections 2 are inserted in the corresponding groove 4. Furthermore, it can be arranged such that the shape of each locking projection 1, positioning projection 2, the groove 3 of the locking projection 1 and groove 4 for the positioning projection 2 are predetermined, so that the locking projection 1 and the positioning projection 2 are inserted respectively into the groove 3 and 4 but only in one predetermined way. For example, if the width of one of the three locking projections 1 is made narrower than that of the other two, and the width of the corresponding groove 3 is made narrower than the other two, then the external joint cover 110 and the inner cylindrical section 11*a* can be fitted in only one way.

On the other hand, it is also possible to put a positioning mark at the position where the external joint cover 110 is superposed on the inner cylindrical section 11*a*.

Figure 4A:
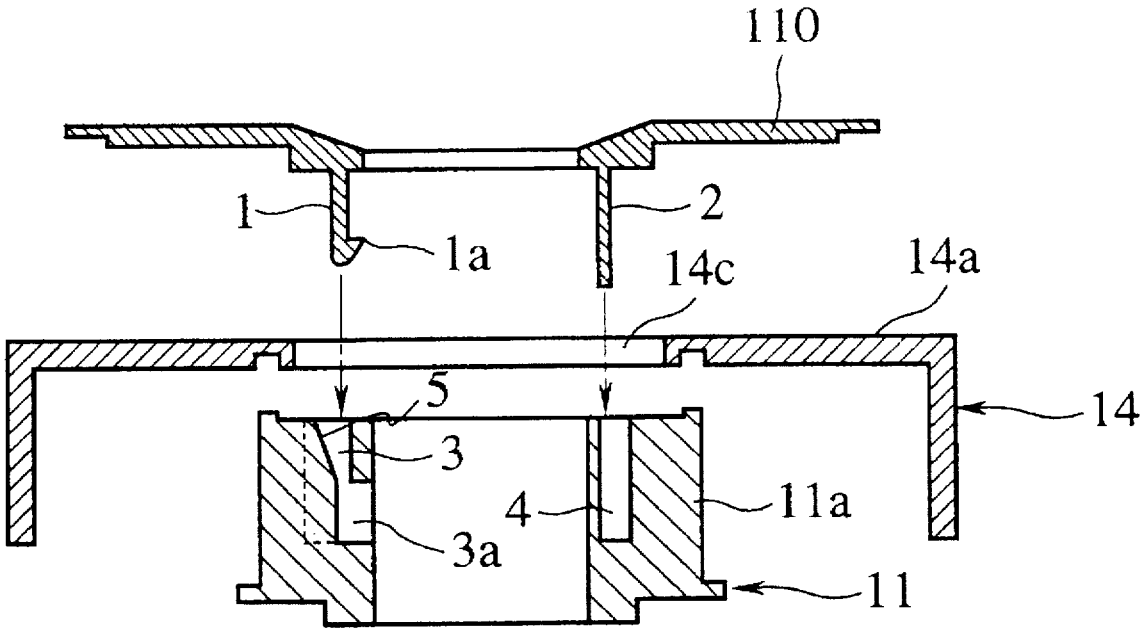
Figure 4B:
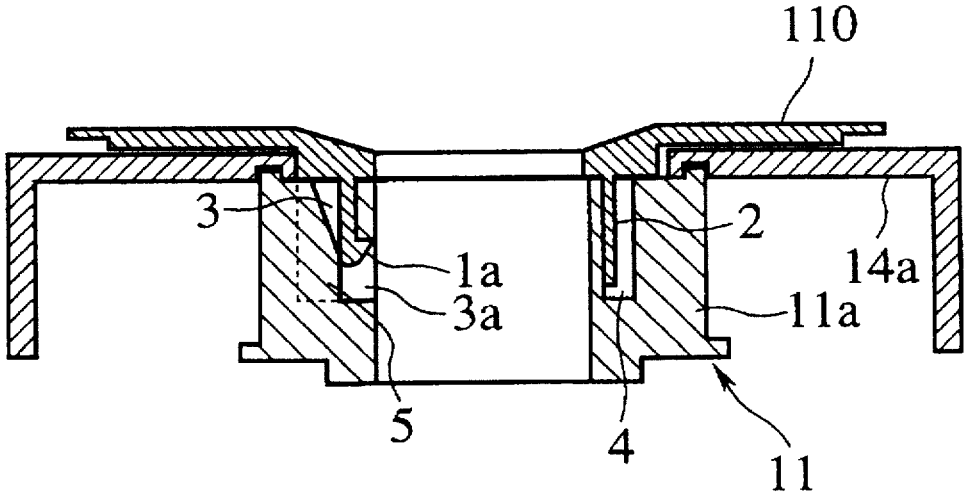
FIG. 4B is a sectional view after the assembling operation has already been carried out.

FIG. 4A is an exploded sectional view of the assembled state of the cover fixing structure to the end surface of the tubular body according to the present invention, showing a state in which the external joint cover 110 constructed as shown in FIG. 3A is fitted to the inner cylindrical section 11*a*, sandwiching therebetween the upper cover 14*a* of the covering member 14. FIG. 4B is a sectional view showing a state in which the external joint cover 110 is already assembled. For fitting the external joint cover 110 to the inner cylindrical section 11*a*, first the locking projections 1 and the positioning projections 2 are inserted into the opening 14*c* of the covering member 14, and thereafter accommodated in the corresponding grooves 3 and 4 respectively. By this operation, the hook portion 1*a* formed at the end portion of each locking projection 1 is engaged with the through hole 3*a* formed in the inner peripheral wall of the inner cylindrical section 11*a*, whereby the external joint cover 110 is readily fixed to the inner cylindrical section 11*a* sandwiching the upper cover 14*a* of the covering member 14 therebetween.

In a state in which the external joint cover 110 is fixed to the inner cylindrical section 11*a*, the external joint cover 110 is fully engaged at the predetermined position of the inner cylindrical section 11*a* by way of three positioning projections 2 and their corresponding grooves 4, so that it can not be shifted in the peripheral and/or radial directions.

Figure 6A:
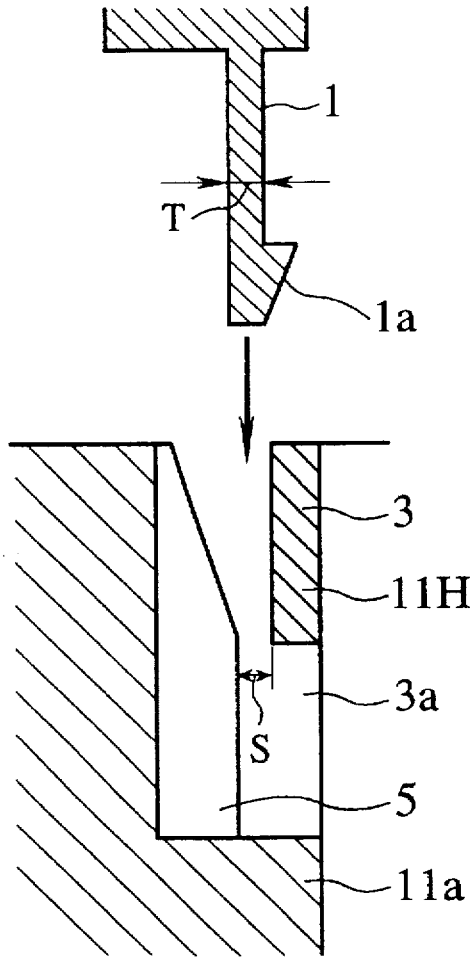
Figure 6B:
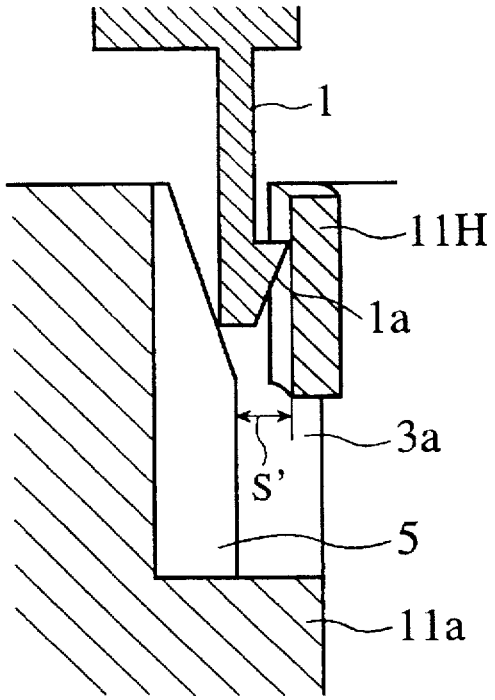
FIG. 6B is an explanatory view showing a deformation of the inner cylindrical section while the locking projection is being inserted into the groove for receiving the locking projection in which the rib is formed.
Figure 6C:
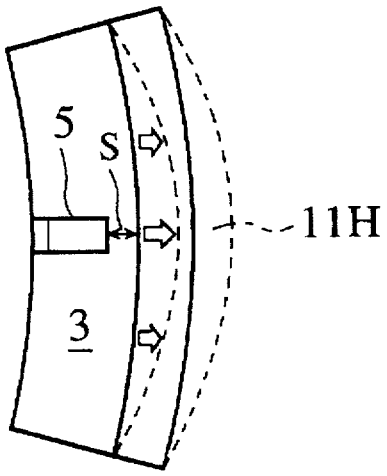
FIG. 6C is a plane view showing a state in which the inner cylindrical section is deformed.

It is to be noted that as explained referring to FIG. 6A hereinbefore, since the gap S is made as thick as the thickness T of the locking projection 1, the hook portion 1*a* of the locking projection 1 can not be set to the locked state shown in FIG. 4B directly from the state shown in FIG. 4A. The process for changing the state shown in FIG. 4A to that shown in FIG. 4B will now be explained referring to FIG. 6, as follows.

When the locking projection 1 is inserted into the groove 3 from the state shown in FIG. 6A, the hook portion 1*a* of the locking projection 1 is naturally guided toward the through hole 3*a* by the tapered section of the rib 5 protrudedly formed within the groove 3. When the locking projection 1 is inserted into the groove 3 for a predetermined depth, the thick hook portion 1*a* abuts against the inner wall surface of the groove 3. From this state, if the locking projection 1 is further pushed into the groove 3, the thin portion 11H as the inner peripheral wall of the inner cylindrical section 11*a* formed above the through hole 3*a* is pushed by the hook portion 1*a*, and deformed inwardly as shown in the perspective view of FIG. 6B, and also as shown by dotted lines in FIG. 6C. As the result, the gap S shown in FIG. 6A is enlarged as a gap S' shown in FIG. 6B, whereby the hook portion 1*a* of the locking projection 1 passes through the gap S'0 to reach the through hole 3*a*. Then, after the hook portion 1*a* of the locking projection 1 has passed, its thin portion 11H returns to the position shown by the solid lines of FIG. 6C by the urging force thereto, which is the state shown in FIG. 4B.

In the state of FIG. 4B, even though an external force is applied to the external joint cover 110, the hook portion 1*a* of the locking projection 1 is still in the locked state and the locking projection 1 is supported from outer side by the rib 5, the locked state of the locking projection 1 is not readily disengaged.

In the embodiment as constructed above, even in case there is applied an external force to the external joint cover 110 by an external vibration or the like, as the locking projection 1 is not shifted within the groove 3, the hook portion 1*a* is not disengaged from the through hole 3.

Figure 7A:
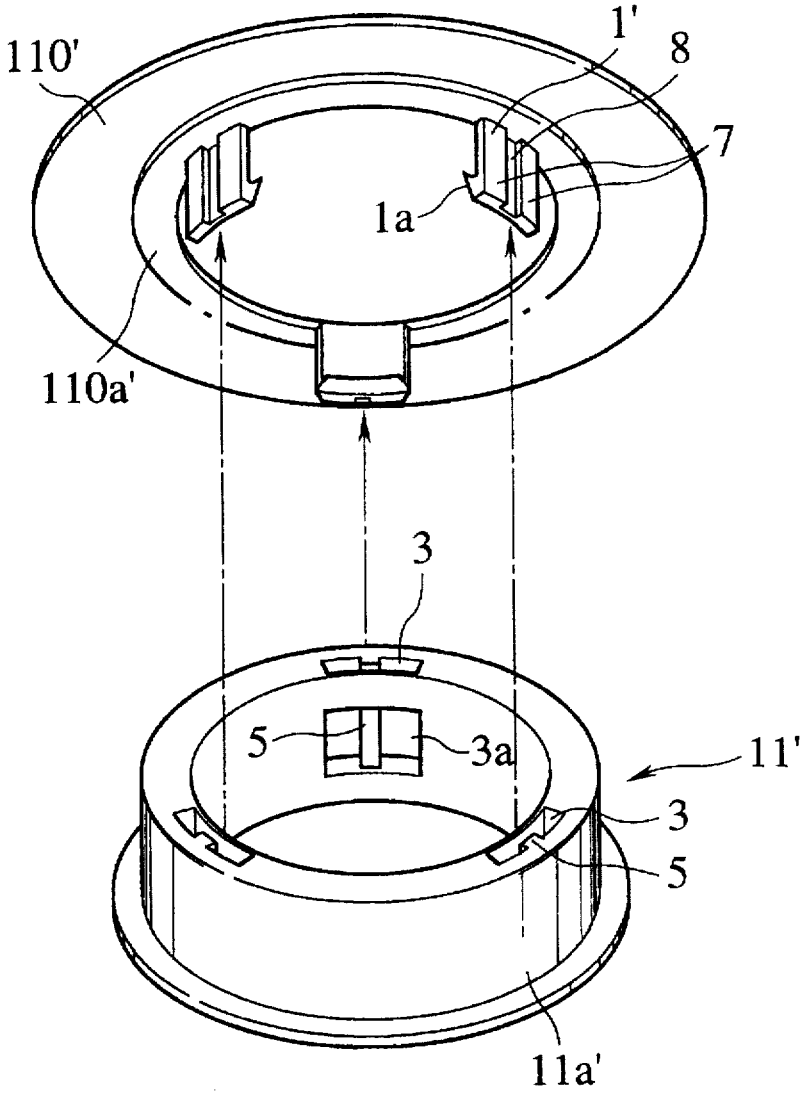

FIG. 7A is a perspective view of an external joint cover 110' showing another embodiment of the locking projection 1 having a different shape, wherein there is no positioning projection 2 provided to be mounted on the mounting surface 110*a* of the external joint cover 110' in the above embodiment, and instead, a positioning guide 7 is provided at the respective sides of a section where the locking projection 1' abuts against side surfaces of the rib 5, and a groove 8 is formed at a location sandwiched between these positioning guides 7. In this embodiment, the positioning guide 7 is formed in the entire rear surface of the locking projection 1' except the groove 8. In other words, the rear side surface of the locking projection 1' is expanded except the groove 8 which is a position to be abutted against the rib 5, whereby its thickness is augmented. It is to be noted that other portions of the external joint cover 110' is same as those of the external joint cover 110 shown in FIG. 3A.

Figure 7B:
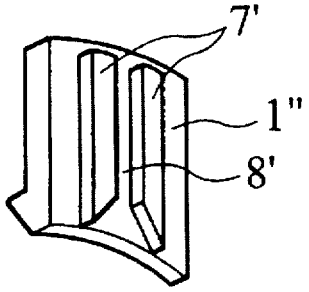
FIG. 7B is a perspective view of a locking projection of still another embodiment of the present invention.

FIG. 7B is a perspective view of a locking projection 1''' by itself, which is a further different embodiment of the locking projection of the present invention, which is a modification of the embodiment shown in FIG. 7A. In this embodiment, each of the positioning guides 7' is formed as a rib having a groove 8' therebetween to be abutted against the rib 5.

As observed above, by forming a pair of positioning guides 7, 7 (7', 7') on the rear surface of the locking projections 1', 1'', the external joint cover 110' fitted to the inner cylindrical section 11*a'* is prevented from rotating in the peripheral direction, even without providing the positioning projections 2 on the mounting surface 110*a'* of the external joint cover 110'.

Although the embodiments are explained to the external joint cover 110, 110' and the inner cylindrical section 11*a*, 11*a'* in the non-contact signal transmission device between the relatively rotating members as an example hereinbefore, the present invention can be applied to any other structure in which a cover is fixed to other thick tubular body.

What is claimed is:

1. A cover fixing structure for fitting a cover to an end surface of a tubular body in an assembly of relatively rotatable members that are connected by a flat cable, comprising:

a plurality of locking projections protrudedly formed on a mounting surface of the cover to be mounted on the end surface of said tubular body, and each having a hook portion at the tip end portion thereof;

grooves for receiving said locking projections formed at positions corresponding thereto on the end surface of said tubular body;

a rib formed on the inner surface of the external circumferential wall of said tubular body within each of said grooves; and a locking section formed on the inner circumferential wall of said tubular body within each of said grooves for receiving said hook portion to lock each of said locking projection and the hook portion thereof;

wherein said rib is formed such that the gap between the rib and the inner circumferential wall of said tubular body is substantially equal to the thickness of said locking projection, and is also provided with a tapering surface inclined toward the entrance of said groove.

2. A cover fixing structure for fitting a cover to an end surface of a tubular body as claimed in claim 1 further comprising:

a plurality of positioning projections protrudedly formed on said mounting surface to be mounted on the end surface of said tubular body; and grooves for receiving said positioning projections formed at positions corresponding thereto on the end surface of said tubular body;

wherein said cover fitted on said tubular body is prevented from rotating in the peripheral direction.

3. A cover fixing structure for fitting a cover to an end surface of a tubular body as claimed in claim 1, wherein a positioning guide is provided on each of said locking projection to be abutted against a side surface of said rib, said positioning guide prevents said cover fitted to said tubular body from rotating in the peripheral direction.

4. A cover fixing structure for fitting a cover to an end surface of a tubular body as claimed in claim 2, wherein the structural relationship between said locking projection and said groove for receiving said locking projection is arranged such that said locking projection can be locked with said groove only in one predetermined condition.

5. A cover fixing structure for fitting a cover to an end surface of a tubular body as claimed in claim 3, wherein the structural relationship between said locking projection and said groove for receiving said locking projection is arranged such that said locking projection can be locked with said groove only in one predetermined condition.

6. A cover fixing structure for fitting a cover to an end surface of a tubular body as claimed in claim 2, wherein the shape of said locking projection and of said groove for receiving said locking projection are arranged such that said locking projection can be locked with said groove only in one predetermined condition.

7. A cover fixing structure for fitting a cover to an end surface of a tubular body as claimed in claim 3, wherein the shape of said locking projection and of said groove for receiving said locking projection are arranged such that said locking projection can be locked with said groove only in one predetermined condition.

* * * * *